US005213121A

United States Patent [19]

O'Brien et al.

[11] Patent Number: 5,213,121

[45] Date of Patent: May 25, 1993

[54] PAINT BRUSH WASHING MACHINE

[75] Inventors: Lawrence B. O'Brien; Walter E. Winston, both of Carmel, Ind.

[73] Assignee: Venture Management Sciences Inc., Carmel, Ind.

[21] Appl. No.: 760,763

[22] Filed: Sep. 16, 1991

[51] Int. Cl.[5] ..... B08B 3/04

[52] U.S. Cl. ..... 134/161; 134/162; 74/48

[58] Field of Search ..... 134/158, 160, 161, 162, 134/140; 74/48

[56] References Cited

U.S. PATENT DOCUMENTS

| | | | |
|---|---|---|---|
| 317,929 | 5/1885 | Cox | 74/48 X |
| 2,239,741 | 4/1941 | Schroder | 134/162 X |
| 2,449,818 | 9/1948 | Olsen | 134/162 X |
| 2,510,912 | 6/1950 | Schurenberg | 134/160 X |
| 2,822,814 | 2/1958 | Torkelson | 134/162 X |
| 2,853,085 | 9/1958 | Torkelson | 134/161 |
| 2,994,331 | 8/1961 | Companys | 134/161 X |
| 3,085,583 | 4/1963 | Sick | 134/162 X |
| 3,095,000 | 6/1964 | Hirst | 134/164 |
| 3,116,745 | 1/1964 | Burning | 134/162 X |
| 5,107,877 | 4/1992 | Chipman | 134/159 X |

FOREIGN PATENT DOCUMENTS

| | | | |
|---|---|---|---|
| 618473 | 3/1927 | France | 74/48 |
| 1370249 | 7/1964 | France | 134/161 |
| 5166 of 1881 | | United Kingdom | 74/48 |

*Primary Examiner*—Frankie L. Stinson
*Attorney, Agent, or Firm*—Woodard, Emhardt, Naughton, Moriarty & McNett

[57] ABSTRACT

A brush holder mounted on a container of cleaning fluid includes clips engaging the handles of one or more brushes to support the brushes with the bristles thereof extending vertically into the cleaning fluid. Two vertically-spaced motor-driven cranks, rotatable in synchronism with each other about vertically spaced horizontal axes, have a horizontally extending crank pin, the lower crank pin being received in a hole in the brush holder, and the upper crank pin being received in a slot in the brush holder. The radii of the crank pins from their respective rotational axes are different so that, as the brush holder is driven up and down and side-wise by the eccentric action of the lower crank pin as it drives it respective portion of the brush holder, the brush holder portions above and below the lower crank pin are driven sideways for distances greater than the lateral excursions of the brush holder portion driven by the lower pin so that as the brushes in the holder are oscillated vertically, a rocking action is imparted to the brush and thereby to the bristles, with the lateral excursions of the distal portions of the bristles at the brush tip being less than those of the proximal portions of the bristles adjacent the brush heel.

9 Claims, 4 Drawing Sheets

PAINT BRUSH WASHING MACHINE

BACKGROUND OF THE INVENTION

1. Field of the Invention

This invention relates generally to paint brush washing machines and more particularly to one in which brush bristles are moved in an oscillating manner in a direction generally parallel to the bristle axis while submerged in a cleaning fluid.

2. Description of the Prior Art

The most pertinent prior art known to us as represented by patents is shown in U.S. Pat. Nos. 3,116,745 to Burning, U.S. Pat. No. 3,252,174 issued to Schoepske, Jr., and U.S. Pat No. 4,759,384 to Kliewer. The latter two of these patents show arrangements whereby a paint brush can be fastened to an adaptor which is chucked in an electric drill whereby the brush can be rotated in a container of cleaning fluid. The bristle axes are oriented outward from the axis of rotation. In the Burning patent the brushes are mounted to a vertical shaft in a container of cleaning fluid and rotated by a hand crank at the top of the shaft. The bristles are generally oriented in a direction outward from the shaft.

At least one other individual has used a different approach in which the brushes are held with their bristles hanging vertically in a container of cleaning fluid and then agitated in a way tending to move the bristles up and down and sideways in amounts that increase at increasing distances from the handle toward the bristle tips, rather than rotated about an axis perpendicular to the bristle axes. We have determined that, in addition to vertical motion along the axis of the bristles, a degree of side to side motion flexes the bristles and agitates the cleaning fluid, greatly enhancing cleaning effectiveness. However, we have found that with the arrangement heretofore used, if the stroke and velocity of the bristles relative to the cleaning fluid are great enough to provide good cleaning performance, there is a tendency to throw cleaning fluid out of the container, and the bristles are in disarray after the cleaning operation. Accordingly, there has remained a need for an effective brush cleaning machine of comparatively small size and which will effectively clean the brushes with a minimal consumption of cleaning fluid and leave the bristles in good condition when the cleaning operation has been finished.

SUMMARY OF THE INVENTION

Described briefly, according to a typical embodiment of the present invention, a brush holder is mounted on a container of cleaning fluid. The holder includes clips for engaging the handles of one or more brushes to support the brushes with the handles and brush heels above the surface of the cleaning fluid, but with the bristles extending vertically into the cleaning fluid with the bristle axes substantially vertical. There are two vertically spaced cranks, each operable in synchronism with the other about vertically spaced horizontal axes and each having a horizontally extending crank pin disposed at some radius from the corresponding rotational axis. The lower pin is received in a hole in the brush holder, and the upper pin is received in a slot in the brush holder. Although the pins are moved about their respective axes in synchronism and at the same rotational speed, their radii from their respective rotational axes are different so that, as the brush holder is driven up and down and side-wise by the eccentric action of the lower crank pin as it drives its respective portion of the brush holder, the portions of the brush holder above and below the lower crank pin are driven sideways for distances slightly different from the lateral distances that the portion of the brush holder pinned to and the lower pin are driven. Consequently, as the brushes clipped in the holder are oscillated vertically as the holder is oscillated vertically by the lower crank pin, a rocking action is also imparted to the brush and thereby to the bristles. The radius from its rotational axis to the upper pin is greater than the radius from its rotational axis to the lower pin so that, as the brushes are pushed down and pulled up in the cleaning fluid, the lateral excursions of the distal portions of the bristles at the brush tip are less than those of the proximal portions of the bristles adjacent the brush heel, whereby ample flow of cleaning fluid through the bristles and adequate flexing of the bristles are achieved, while disarray of the brush tip and splashing of the cleaning fluid are minimized.

DESCRIPTION OF THE PREFERRED EMBODIMENT

Figure 1:
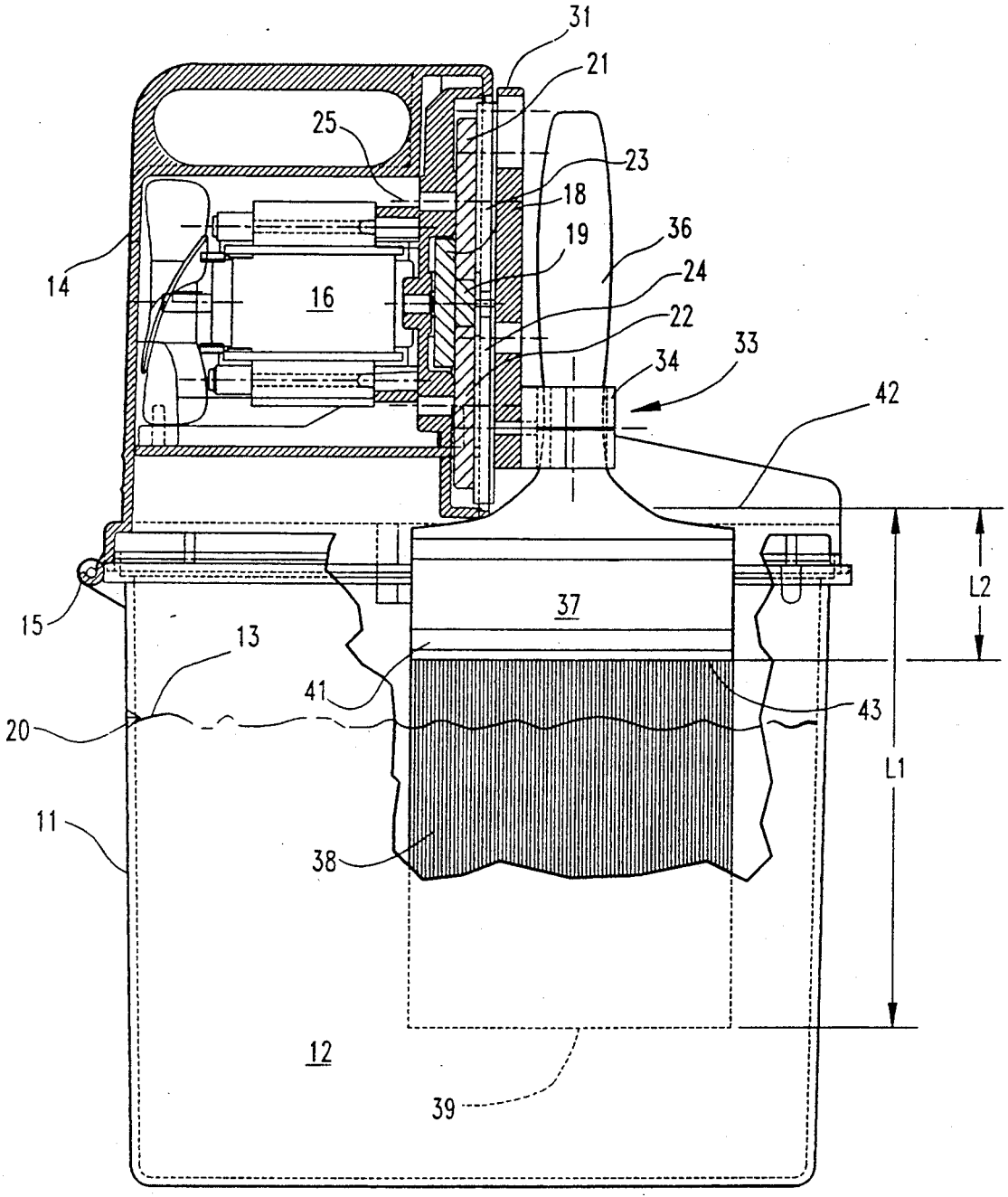
FIG. 1 is a partial cross-sectional side view of the brush washing machine with paint brush attached.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
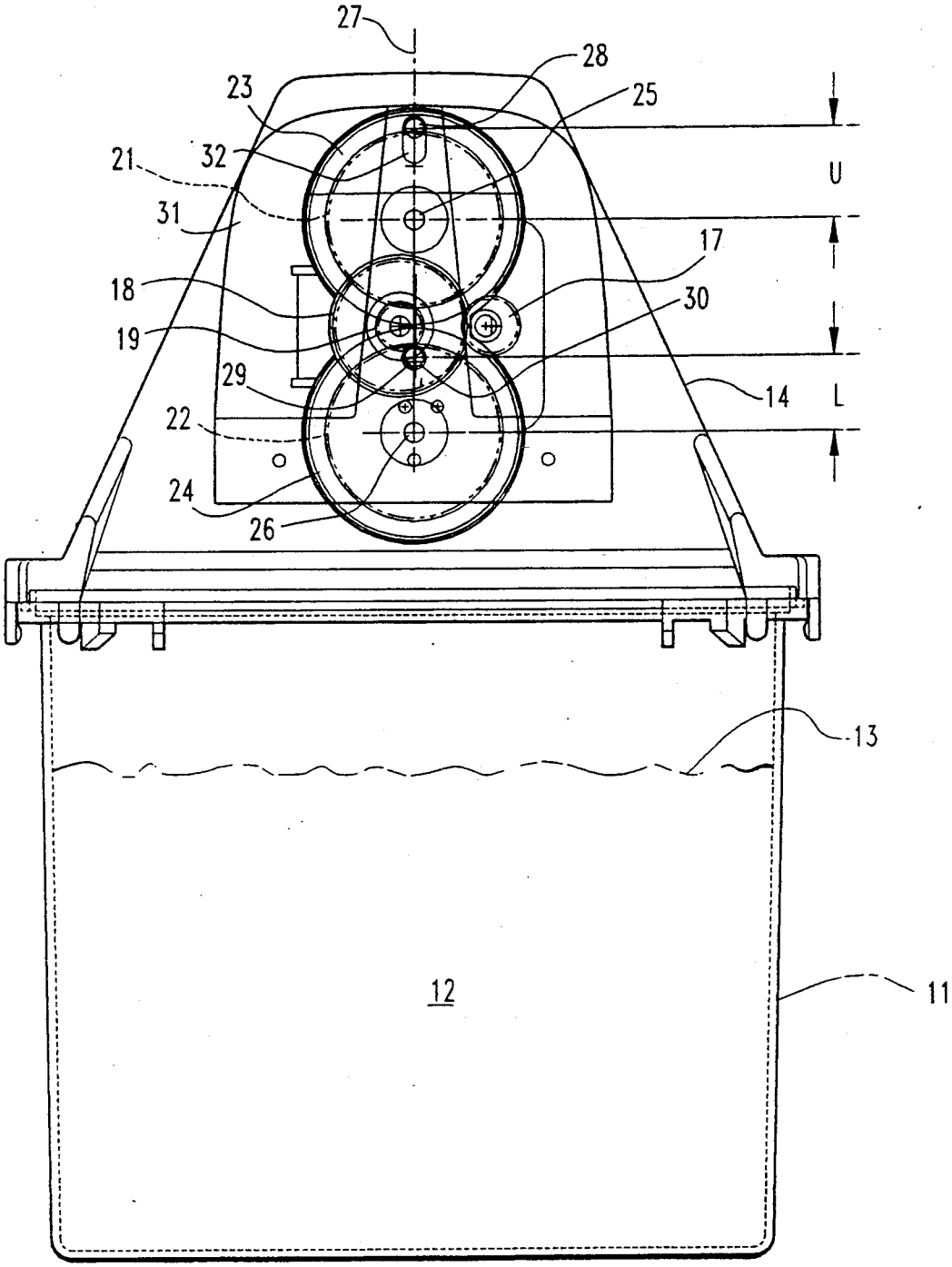
FIG. 2 is a partial cross-sectional front view of the brush washing machine.

Referring now to FIGS. 1 and 2, the bucket 11 holds cleaning fluid 12 to a level 13 indicated by mark 20. A mechanism housing 14 is mounted to the bucket 11 by hinges 15 at the rear, as shown. Spring clips at the sides and rear instead of the hinges can be used if desired. Housing 14 encloses a drive motor 16 having a pinion 17 on its output shaft which drives a gear 18 received in a well in the front face of the housing 14. Gear 18 has its own pinion 19 on its front face and which drives upper and lower gears 21 and 22, respectively, in the same rotational direction which, for present purposes, can be considered to be clockwise as viewed from the front. Each of these gears has a disk on its front face, the disk 23 on the front of gear 21 and the disk 24 on the front of gear 22. These two gears rotate on axes 25 and 26, respectively, which lie in a vertical plane 27 extending down through the center of the bucket 11.

Disk 23 has a pin 28 extending forward from it. Disk 24 has a pin 29 extending forward from it. The radius U to the pin 28 from the rotational axis 25 of disk 23 is greater than the radius L to the pin 29 from the rotational axis 26 of the disk 24. These pins serve as cranks, so that the crank arm for upper pin 28 is greater than that for lower pin 29 for a reason which will be described hereinafter.

A brush holder "T-bar" 31 is mounted to pin 29 which is received through a hole 30 through the brush holder. Pin 28 is received in a slot 32 in the brush holder near its top. These pins may be provided with suitable heads or sleeves so that they are free to rotate (in the case of pin 29) and rotate and slide (in the case of pin 28) in their respective holes and slots in the brush holder, while holding the brush holder in the correct vertical attitude shown, during operation of the machine. The diametrical clearance between the outer surface of the pin and the respective receiving hole or slot in the brush holder 31 is about 0.005 inches.

Figure 3:
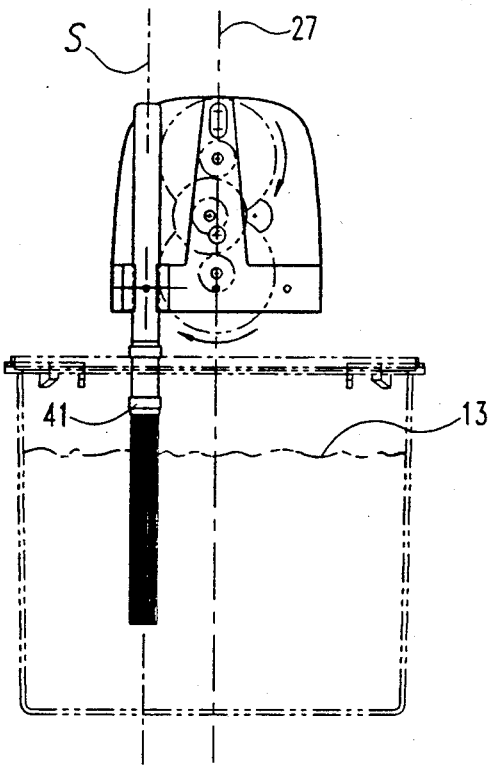
FIG. 3 is a partial cross-sectional frontal view of the top position of the brush washing machine.

A clip unit 33 is mounted to the front of the brush holder 31 immediately below the drive pin 29. It includes one or more clips 34 which are resilient and well suited to gripping the handle 36 of a paint brush above the heel or ferrule 37 thereof, so that the brush 38 is suspended with the bristles of the bristle pack hanging vertically from the heel to the tip 39. Consequently, with the pins 28 and 29 in their uppermost position in vertical plane 27, the brushes hang vertically and the axes of their bristles hang essentially vertically from the bristle pack mount at the heel to their distal ends at the tip 39. In this condition, the brushes are situated at the top of the stroke as shown in FIG. 3 (where only one brush is shown to avoid complicating the drawing). In this condition, the bristle pack mount and confinement band 41 of the brush are out of the cleaning fluid. That is to say that they are slightly above the surface 13 of the cleaning fluid.

OPERATION

Figure 4:
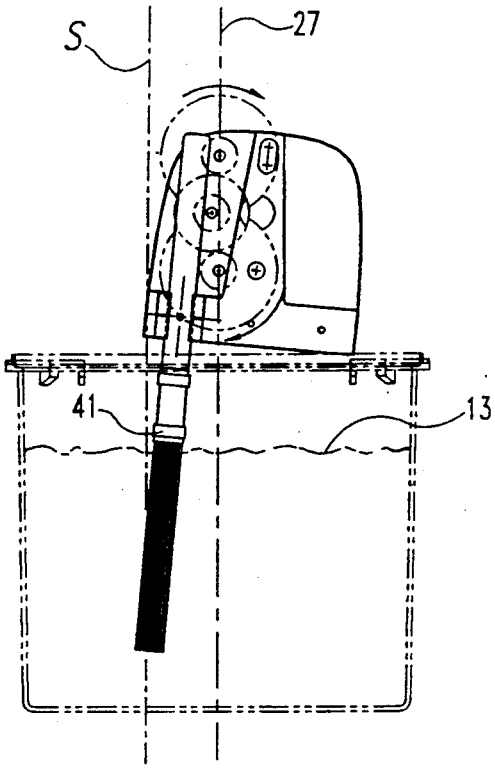
FIG. 4 is a partial cross sectional frontal view of the mid position 1 of the brush washing machine.
Figure 6:
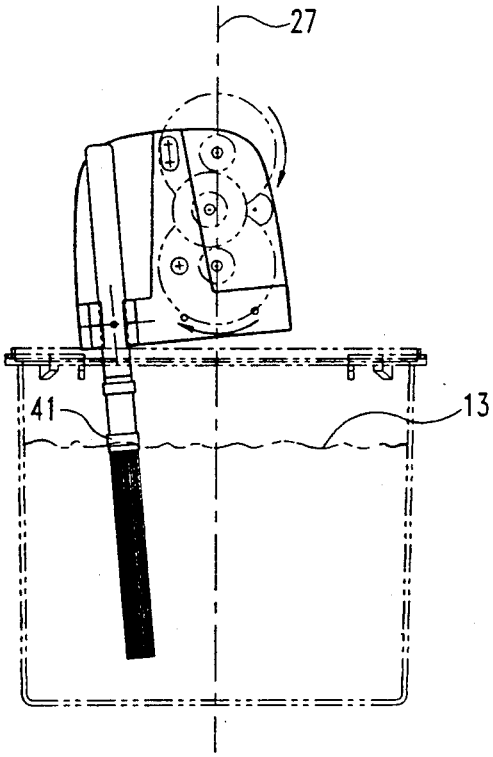
FIG. 6 is a partial cross sectional frontal view of the mid position 2 of the brush washing machine.
Figure 5:
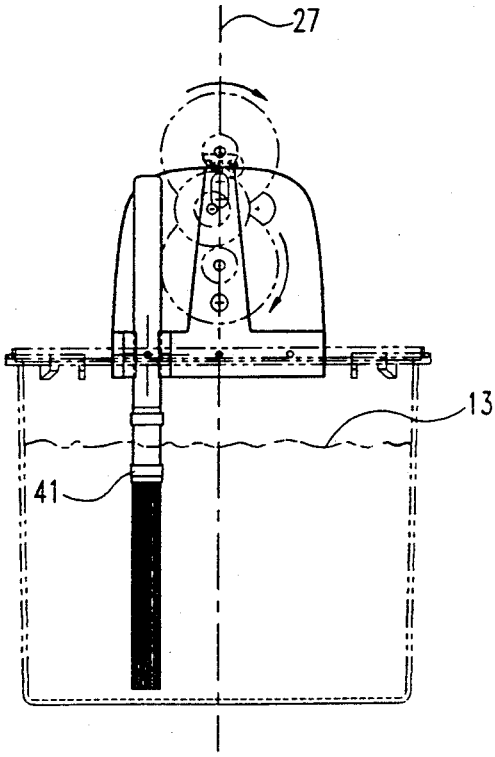
FIG. 5 is a partial cross sectional frontal view of the bottom position of the brush washing machine.

In the operation of the machine, it begins with the brush holder at its uppermost position as shown in FIG. 3. The brushes are installed in the clips. Then the cleaning fluid is placed in the bucket to the level 13 just below the bottom of the band 41 of the brushes. Then the machine is started. Assuming that the drive of the gears 21 and 22 is in the clockwise direction, the brush holder will move down to the position shown in FIG. 4 at 90 degrees rotation of disc 24, on downward to the position shown in FIG. 5 at 180 degrees, at the bottom of the stroke and up to the position in FIG. 6 at 270 degrees and up to starting position of FIG. 3, thereby completing one rotation. During this motion, and although the tips of the bristles have moved laterally outward from their vertical starting plane (plane S for the illustrated brush; plane 27 for a middle brush, for example), the proximal portions of the bristles will have moved farther out from plane S as shown in the FIG. 4 which shows the brush in the mid-stroke position. Similarly, during the upstroke, the bristles at their tips will remain closer to their respective starting planes than will the proximal portions of the bristles. In this manner, although there is a relatively significant lateral excursion of the bristles near their proximal ends, there is much less lateral excursion of the bristles near their tips. This is true of the other two or more brushes which may be mounted to the clip unit, each of which moves in the same manner as the center brush. Thus, if we consider the plane 27 to be the plane of rest for the center brush and note that it is parallel to the plane of rest of a side brush, the motion of the side brush may be viewed with respect to the plane of rest for the center brush. The excursions of the tips of the brushes in their respective planes are the same as those for the tip of the side brush with respect to plane S. Likewise, the excursions of the proximal portions of the bristles for the other brushes with respect to their rest planes are the same as those for the proximal portions of the bristles of the side brush.

Figure 7:
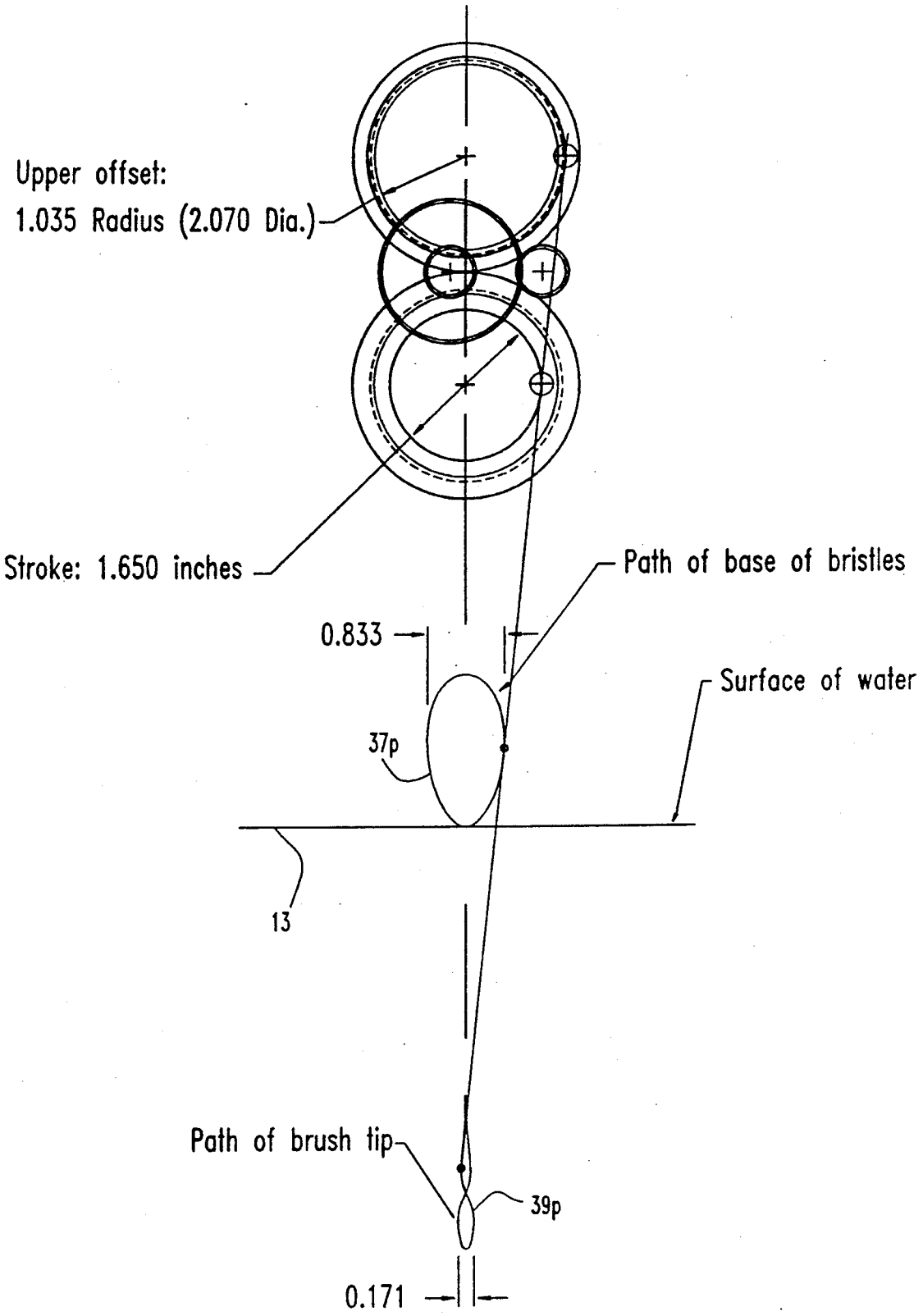
FIG. 7 is a diagram of the preferred paths of travel of the brush tip and bristle base (heel) during the operation of the machine.

It will be recognized from the foregoing description that the length of the brush cleaning stroke in a vertical direction is determined by the offset of the pin 29 from the rotational axis 26 of the gear 22 and thereby the disk 24. Since pin 29 and pin 28 are serving as crank pins for the lower and upper portions of the brush holder, respectively, this offset of the lower pin 29 can be considered the crank "arm". Similarly, the offset of the upper pin 28 from the rotational axis 25 is the crank arm for that pin 28. As suggested above, the operating relationship between the path of travel of the handle of the brush and the path of travel of the tips of the bristles is defined by the crank arms of the respective cranks. Accordingly, if the pin on the upper crank and the pin on the lower crank were equal distance from the crank centers, the resulting attitude of the brushes would remain perpendicular to a horizontal plane on which the bucket rests, throughout the stroke cycle. If the pin in the upper crank were closer to the rotational crank axis than the pin of the lower crank to its rotational crank axis, the brush handles would move in a restricted path and the tips of the bristles would move in a sweeping path. The greater the difference between the offset of the pin in the upper crank and the offset of the pin in the lower crank, the greater the angle the brushes enter the cleaning fluid and the wider the sweeping motion of the brush tips in the fluid. The wider path or sweeping motion of the brush tips would create more sloshing action of the fluid. Therefore, the pin positioning configuration and optimum brush washing operation is accomplished by positioning the upper crank pin with an offset equal to or greater than the offset of the lower crank pin, as shown and described herein. With greater offset of the upper crank pin, the brush handles move in a wider path during operation and the brush tips move in a narrower path. This can be seen upon reference to FIG. 7 which shows the preferred path of the brush tip at the plotted curve 39*p* and the preferred path of the base of the bristles in the handle ferrule at curve 37*p* with reference to the surface of the cleaning fluid at 13. Of course, the upper end (not shown) of the handle will move in an even wider path than the path 37*p*.

Due to the synchronized interrelationship of the pins during the operating cycle in this configuration, the length of the stroke may be maximized in a small container with minimized sloshing or splashing action of the cleaning fluid. The interdependent relationship of the two pins and the resulting motion of the brush tips in the cleaning fluid during operation is unique and very helpful in minimizing overall size of the device and minimizing the amount of cleaning fluid used.

As an example, where the brush length "L1" from the tip to the top of the heel as at 42 in FIG. 1, for example, is 6.250 inches, and the distance L2 from the heel to the proximal portion of the bristles at 43 is 1.750 inches, it is desirable to have a brush stroke of 1.650 inches and a difference of 0.66 inches between the maximum lateral excursion of the proximal portion of the bristles and the brush tip. The maximum lateral excursion of the brush tip should be 0.17 inches. Where the crank rotational axes 25 and 26 are 2.482 inches apart, the offset or crank arms "U" and "L" (FIG. 2) of the respective crank pins 28 and 29 are 1.080 inches and 0.825 inches, respectively. Examples of suitable crank pins are flanged brass bushings fastened to the crank with #10 screws. The radii of the bushings themselves are 0.355 inches, for example. If the mounting screws are right-hand threaded, rotation of the gears 21 and 22 may be preferably counterclockwise to minimize the chances of the screws loosening. It should be kept in mind that the radius (offset) to the axis of the lower crank pin determines the vertical stroke of the brush in the cleaning fluid, whereas the upper crank pin offset determines the angle limits of the brushes as they are moved by the holder. If offsets are the same, the brush handles will be oscillated vertically only.

Preferably all materials exposed to the cleaning fluid are made of plastic. The individual brushes can be separately pulled loose from their holding clips after the cleaning is completed. Alternatively, if the housing is hinged as shown, the mechanism housing with the brushes still mounted in the brush holder can be swung upward about the hinges 16 to a position suitable for removing the brushes from the cleaning fluid while permitting them to drain into the fluid.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A paint brush washing machine comprising:

a reservoir of cleaning fluid;

a brush holder associated with the reservoir, said brush holder having means for attachment thereto of a paintbrush with bristles such that the bristles extend into the cleaning fluid;

two vertically spaced cranks each operable in synchronism with the other about vertically spaced horizontal rotational axes and each having a horizontally extending crank pin disposed at some radius from the corresponding rotational axis, the radius from its rotational axis to the upper crank pin being equal to or greater than the radius from its rotational axis to the lower crank pin;

the lower pin being received in a hole and the upper pin being received in a slot in said brush holder; and a means coupled to at least one of said cranks for rotation of said cranks.

2. The brush washing machine of claim 1 wherein said means for rotation of said cranks comprises;

a drive motor having a pinion on its output shaft;

a gear driven by the pinion and having a second pinion thereon; and upper and lower gears attached to the upper and lower ones of said cranks and driven by the second pinion.

3. The brush washing machine of claim 2 wherein said means for rotation of said disks is contained by a mechanism housing mounted by hinges at the rear of said bucket.

4. The brush washing machine of claim 1 wherein a mark is Provided on the bucket and utilized to indicate the proper level of cleaning fluid.

5. The brush washing machine of claim 1 wherein said pins are provided with means to rotate freely in the brush holder.

6. The brush washing machine of claim 1 wherein said brush holder includes a clip unit with at least one resilient clip.

7. The brush washing machine of claim 6 wherein said brush holder has a plurality of clips.

8. The brush washing machine of claim 1 wherein portions of said machine that contact said cleaning fluid are made from plastic.

9. A paint brush washing machine comprising:

a bucket of cleaning fluid with a mark to indicate the proper fluid level;

a brush holder mounted on said bucket of cleaning fluid and having clips for engaging the handle of a paint brush having bristles such that said bristles extend substantially vertically into the cleaning fluid;

upper and lower vertically spaced discs rotatable in synchronism about vertically spaced horizontal axes each disc having a horizontally extending pin disposed at a radius from its corresponding rotational axis that is different from the radius to the other pin from its corresponding rotational axis, the radius to the pin in the upper disc being greater than the radius to the pin in the lower disc;

the pin in the lower disc being received in a hole in the brush holder, and the pin in the upper disc being received in a slot in the brush holder; and a drive motor driving the discs in synchronism.

* * * * *